US007210292B2

(12) United States Patent
Price et al.

(10) Patent No.: US 7,210,292 B2
(45) Date of Patent: May 1, 2007

(54) HYDRAULIC SYSTEM HAVING VARIABLE BACK PRESSURE CONTROL

(75) Inventors: Robert J. Price, Dunlap, IL (US); Francis J. Raab, Edwards, IL (US)

(73) Assignees: Caterpillar Inc, Peoria, IL (US); Shin Caterpillar Mitsubishi Ltd (JP)

( * ) Notice: Subject to any disclaimer, the term of this patent is extended or adjusted under 35 U.S.C. 154(b) by 98 days.

(21) Appl. No.: 11/092,617

(22) Filed: Mar. 30, 2005

(65) Prior Publication Data

US 2006/0218912 A1 Oct. 5, 2006

(51) Int. Cl.
*F16D 31/02* (2006.01)

(52) U.S. Cl. ..... 60/426; 60/433; 60/459

(58) Field of Classification Search ..... 60/426, 60/433, 459

See application file for complete search history.

(56) References Cited

U.S. PATENT DOCUMENTS

| | | | | |
|---|---|---|---|---|
| 5,138,838 | A * | 8/1992 | Crosser | 60/433 |
| 5,182,908 | A | 2/1993 | Devier et al. | |
| 5,692,376 | A | 12/1997 | Miki et al. | |
| 5,868,059 | A | 2/1999 | Smith | |
| 6,062,331 | A | 5/2000 | Grunow et al. | |
| 6,079,131 | A | 6/2000 | Oshina et al. | |
| 6,167,337 | A | 12/2000 | Haack et al. | |
| 6,293,033 | B1 | 9/2001 | Moriya et al. | |
| 6,330,502 | B1 | 12/2001 | Cetinkunt et al. | |
| 6,378,231 | B1 | 4/2002 | Moriya et al. | |
| 6,467,264 | B1 * | 10/2002 | Stephenson et al. | 60/460 |
| 6,542,789 | B2 | 4/2003 | Ufheil | |
| 6,647,718 | B2 * | 11/2003 | Stephenson | 60/403 |
| 6,662,705 | B2 * | 12/2003 | Huang et al. | 91/433 |
| 6,761,029 | B2 | 7/2004 | Linerode | |
| 6,789,387 | B2 * | 9/2004 | Brinkman | 60/414 |
| 6,820,355 | B2 | 11/2004 | Yoshino et al. | |
| 2004/0006980 | A1 | 1/2004 | Berthod et al. | |
| 2004/0159101 | A1 | 8/2004 | Bruun | |

FOREIGN PATENT DOCUMENTS

| | | |
|---|---|---|
| EP | 763315 | 3/1997 |
| WO | WO 01/77899 | 10/2001 |

* cited by examiner

*Primary Examiner*—Igor Kershteyn
(74) *Attorney, Agent, or Firm*—Finnegan, Henderson, Farabow, Garrett & Dunner

(57) ABSTRACT

A hydraulic system for a work machine having a linkage system is disclosed. The hydraulic system has a tank configured to hold a supply of fluid and at least one hydraulic actuator associated with the linkage system to affect movement of the linkage system. The at least one hydraulic actuator has a first pressure chamber and a second pressure chamber. The hydraulic system also has an independent metering valve associated with the first pressure chamber. The independent metering valve has a valve element movable between a first position at which fluid communication between the first pressure chamber and the tank is blocked, and a second position at which fluid is allowed to drain from the first pressure chamber to the tank. The hydraulic system further has at least one sensor configured to sense a parameter indicative of a pressure in the second pressure chamber, and a controller in communication with the independent metering valve and the sensor. The controller is configured to move the valve element of the independent metering valve in response to the pressure.

36 Claims, 2 Drawing Sheets

HYDRAULIC SYSTEM HAVING VARIABLE BACK PRESSURE CONTROL

TECHNICAL FIELD

The present disclosure relates generally to a hydraulic system, and more particularly, to a hydraulic system having variable back pressure control.

BACKGROUND

Work machines such as, for example, excavators, loaders, dozers, and other types of heavy machinery use multiple hydraulic actuators in conjunction with a linkage system to accomplish a variety of tasks. The hydraulic actuators may include a tube having a head-end pressure chamber and a rod-end pressure chamber separated by a piston assembly. The tube may be connected to one portion of the linkage assembly, while the piston assembly may be connected to a different portion. The head and rod-end pressure chambers may be selectively filled with or drained of pressurized fluid to move the piston assembly relative to the tube, which affects movement of the linkage system. During movement of the linkage system, it is possible for gravity acting on the linkage system to cause the piston assembly to force draining of fluid from one of the rod or head-end chambers faster than fluid can fill the other of the rod or head-end chambers. In this situation, a void or vacuum may be created by the expansion of the filling chamber (voiding). Voiding can result in undesired and/or unpredictable movement of the work machine and could damage the hydraulic actuators.

One method of minimizing voiding within a hydraulic actuator is described in U.S. Pat. No. 5,868,059 (the '059 patent) issued to Smith on Feb. 9, 1999. The '059 patent describes an electrohydraulic valve arrangement in combination with an implement pump, a tank, and a hydraulic cylinder having a rod-end chamber and a head-end chamber. The valve arrangement includes a plurality of electrohydraulic displacement control independent metering valve modules and a return check valve disposed in an outlet between the valve arrangement and the tank to generate a back pressure for the valve arrangement. This generated back pressure may limit the rate that fluid drains from the head-end or rod-end chambers. If the drain rate is limited to the same as or less than the fill rate of the other of the head-end or rod-end chambers, voiding may be minimized. The level of the back pressure is established by a spring.

Although the electrohydraulic valve arrangement of the '059 patent may minimize voiding, it may do so inefficiently. In particular, because the back pressure restriction is always active, regardless of the likelihood of voiding, the pump supplying pressurized fluid to the electrohydraulic valve arrangement must be continuously operated at a high power usage level to overcome the continuous back pressure restriction. In addition, because the back pressure restriction is constant, velocity control of the hydraulic actuators may be limited. There may be situations when it is desirable to reduce or increase the back pressure restriction to allow for increased or decreased velocity of the associated linkage system.

The disclosed hydraulic system is directed to overcoming one or more of the problems set forth above.

SUMMARY OF THE INVENTION

In one aspect, the present disclosure is directed to a hydraulic system for a work machine having a linkage system. The hydraulic system includes a tank configured to hold a supply of fluid and at least one hydraulic actuator associated with the linkage system to affect movement of the linkage system. The at least one hydraulic actuator has a first pressure chamber and a second pressure chamber. The hydraulic system also includes an independent metering valve associated with the first pressure chamber. The independent metering valve has a valve element movable between a first position at which fluid communication between the first pressure chamber and the tank is blocked, and a second position at which fluid is allowed to drain from the first pressure chamber to the tank. The hydraulic system further includes at least one sensor configured to sense a parameter indicative of a pressure in the second pressure chamber, and a controller in communication with the independent metering valve and the sensor. The controller is configured to move the valve element of the independent metering valve in response to the pressure.

In another aspect, the present disclosure is directed to a method of operating a hydraulic system associated with a linkage system. The method includes moving an independent metering valve element between a first position and a second position to selectively block fluid from or drain fluid from a first chamber of a hydraulic actuator to a tank. The method also includes sensing a parameter indicative of a pressure within a second pressure chamber of the hydraulic actuator. The method further includes moving the independent metering valve element between the first and second positions in response to the pressure.

DETAILED DESCRIPTION

Figure 1:
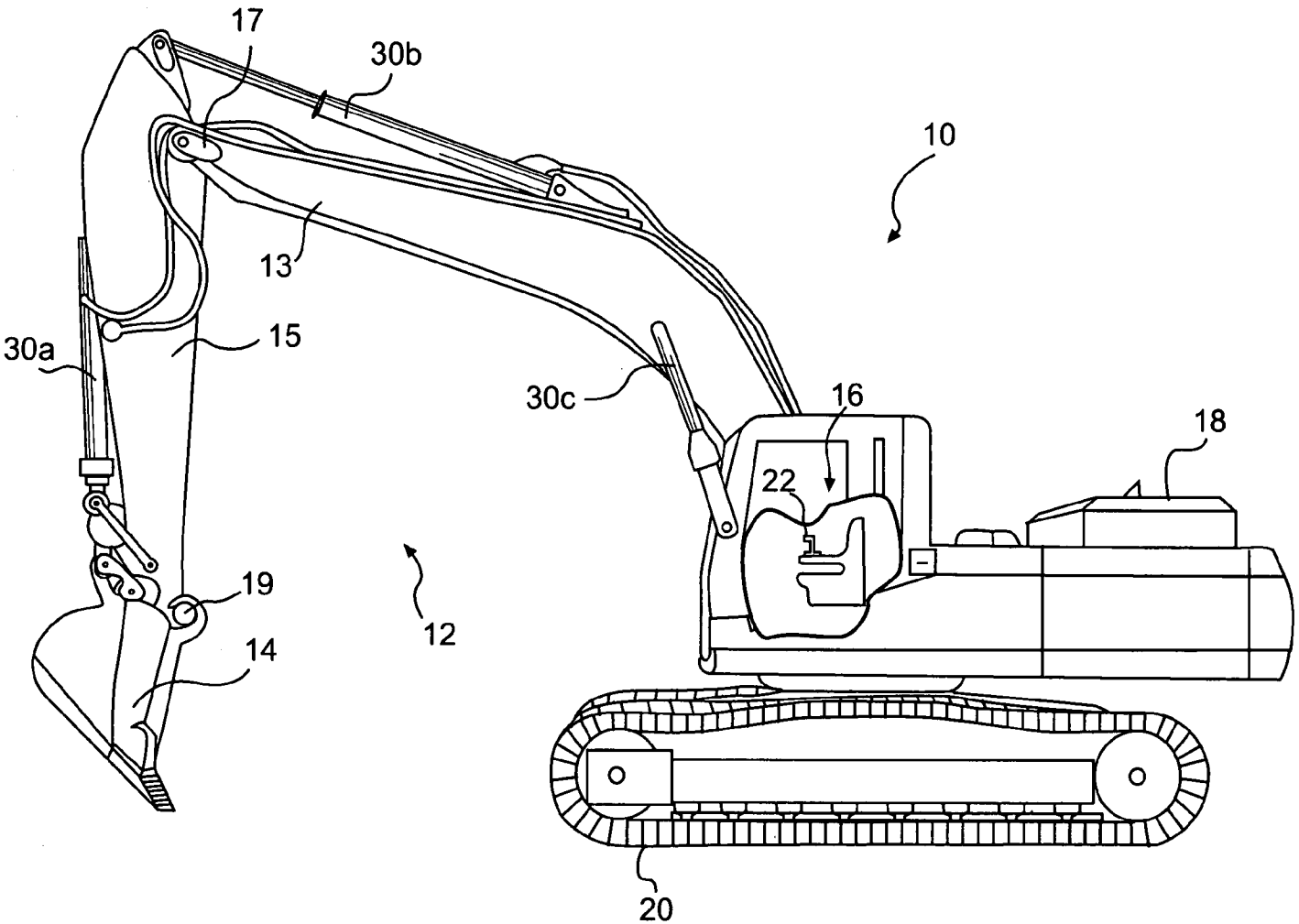
FIG. 1 is a side-view diagrammatic illustration of an exemplary disclosed work machine.

FIG. 1 illustrates an exemplary work machine 10. Work machine 10 may be a fixed or mobile machine that performs some type of operation associated with an industry such as mining, construction, farming, transportation, or any other industry known in the art. For example, work machine 10 may be an earth moving machine such as an excavator, a dozer, a loader, a backhoe, a motor grader, or any other earth moving machine. Work machine 10 may include a linkage system 12, a work tool 14 attachable to linkage system 12, one or more hydraulic actuators 30*a–c* interconnecting linkage system 12, an operator interface 16, a power source 18, and at least one traction device 20.

Linkage system 12 may include any structural unit that supports movement of work machine 10 and/or work tool 14. Linkage system 12 may include, for example, a stationary base frame (not shown), a boom 13, and a stick 15. Boom 13 may be pivotally connected to the frame, while stick 15 may be pivotally connected to boom 13 at a join 17. Work tool 14 may pivotally connect to stick 15 at a joint 19. It is contemplated that linkage system 12 may alternatively include a different configuration and/or number of linkage members than what is depicted in FIG. 1.

Numerous different work tools 14 may be attachable to stick 15 and controllable via operator interface 16. Work tool 14 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Work tool 14 may be configured to pivot, rotate, slide, swing, lift, or move relative to work machine 10 in any manner known in the art.

Operator interface 16 may be configured to receive input from a work machine operator indicative of a desired work tool movement. Specifically, operator interface 16 may include an operator interface device 22 such as, for example, a multi-axis joystick located to one side of an operator station. Operator interface device 22 may be a proportional-type controller configured to position and/or orient work tool 14 and to produce an interface device position signal indicative of a desired movement of work tool 14. It is contemplated that additional and/or different operator interface devices may be included within operator interface 16 such as, for example, wheels, knobs, push-pull devices, switches, pedals, and other operator interface devices known in the art.

Power source 18 may be an engine such as, for example, a diesel engine, a gasoline engine, a gaseous fuel-power engine such as a natural gas engine, or any other engine known in the art. It is contemplated that power source 18 may alternatively embody another source of power such as a fuel cell, a power storage device, an electric or hydraulic motor, or another source of power known in the art.

Traction device 20 may include tracks located on each side of work machine 10 (only one side shown). Alternatively, traction device 20 may include wheels, belts, or other traction devices. Traction device 20 may or may not be steerable. It is contemplated that if work machine 10 embodies a stationary machine, traction device 20 may be omitted.

Figure 2:
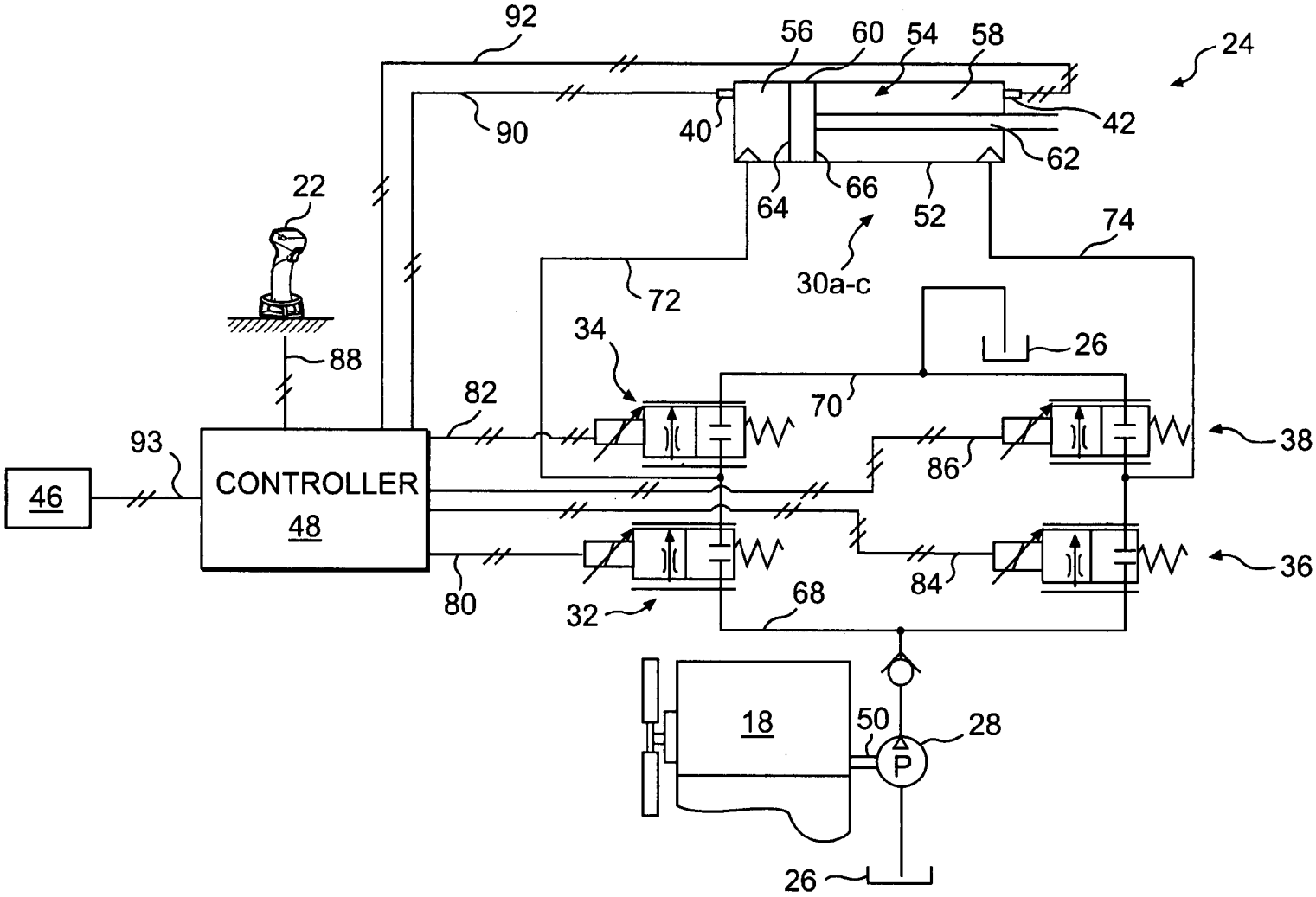
FIG. 2 is a schematic illustration of an exemplary disclosed hydraulic system for the work machine of FIG. 1.

As illustrated in FIG. 2, work machine 10 may include a hydraulic system 24 having a plurality of fluid components that cooperate together to move work tool 14. Specifically, hydraulic system 24 may include a tank 26 holding a supply of fluid, and a source 28 configured to pressurize the fluid and to direct the pressurized fluid to hydraulic actuators 30*a–c*. While FIG. 1 depicts three actuators, identified as 30*a*, 30*b*, and 30*c*, for the purposes of simplicity, the hydraulic schematic of FIG. 2 depicts only one hydraulic actuator. Hydraulic system 24 may include four independent metering valves, including a head-end supply valve 32, a head-end drain valve 34, a rod-end supply valve 36, and a rod-end drain valve 38. Thus, two independent metering valves may be associated with each end of a hydraulic actuator 30*a–c*. The hydraulic system 24 also may include a head-end pressure sensor 40 and a rod-end pressure sensor 42 associated with each hydraulic actuator 30*a–c*. Hydraulic system 24 may further include a linkage sensor 46 and a controller 48 in communication with the fluid components of hydraulic system 24 and operator interface device 22. It is contemplated that hydraulic system 24 may include additional and/or different components such as, for example, accumulators, restrictive orifices, check valves, pressure relief valves, makeup valves, pressure-balancing passageways, temperature sensors, tool recognition devices, and other components known in the art.

Tank 26 may constitute a reservoir configured to hold a supply of fluid. The fluid may include, for example, a dedicated hydraulic oil, an engine lubrication oil, a transmission lubrication oil, or any other fluid known in the art. One or more hydraulic systems within work machine 10 may draw fluid from and return fluid to tank 26. It is also contemplated that hydraulic system 24 may be connected to multiple separate fluid tanks.

Source 28 may be configured to produce a flow of pressurized fluid and may include a pump such as, for example, a variable displacement pump, a fixed displacement pump, or any other source of pressurized fluid known in the art. Source 28 may be drivably connected to power source 18 of work machine 10 by, for example, a countershaft 50, a belt (not shown), an electrical circuit (not shown), or in any other suitable manner. Alternatively, source 28 may be indirectly connected to power source 18 via a torque converter (not shown), a gear box (not shown), or in any other manner known in the art. It is contemplated that multiple sources of pressurized fluid may be interconnected to supply pressurized fluid to hydraulic system 24.

Hydraulic actuators 30*a–c* may include fluid cylinders that interconnect work tool 14 and linkage system 12. It is contemplated that hydraulic actuators other than fluid cylinders may alternatively be implemented within hydraulic system 24 such as, for example, hydraulic motors or any other type of hydraulic actuator known in the art. As illustrated in FIG. 2, each of hydraulic actuators 30*a–c* may include a tube 52 and a piston assembly 54 disposed within tube 52. One of tube 52 and piston assembly 54 may be pivotally connected between members of linkage system 12 and/or work tool 14. Each of hydraulic actuators 30*a–c* may include a first chamber 56 and a second chamber 58 separated by a piston 60. First and second chambers 56, 58 may be selectively supplied with pressurized fluid from source 28 and selectively drained of the fluid to cause piston assembly 54 to displace within tube 52, thereby changing the effective length of hydraulic actuators 30*a–c*. The expansion and retraction of hydraulic actuators 30*a–c* may function to assist in moving work tool 14 and linkage system 12.

Piston assembly 54 may include piston 60 axially aligned with and disposed within tube 52, and a piston rod 62 connectable to the frame of work machine 10, boom 13, stick 15, or work tool 14 (referring to FIG. 1). Piston 60 may include a first hydraulic surface 64 and a second hydraulic surface 66 opposite first hydraulic surface 64. An imbalance of force caused by fluid pressure on first and second hydraulic surfaces 64, 66 may result in movement of piston assembly 54 within tube 52. For example, a force on first hydraulic surface 64 being greater than a force on second hydraulic surface 66 may cause piston assembly 54 to displace to increase the effective length of hydraulic actuators 30*a–c*. Similarly, when a force on second hydraulic surface 66 is greater than a force on first hydraulic surface 64, piston assembly 54 will retract within tube 52 to decrease the effective length of hydraulic actuators 30*a–c*. A flow rate of fluid into and out of first and second chambers 56 and 58 may determine a velocity of hydraulic actuators 30*a–c*, while a pressure of the fluid in contact with first and second hydraulic surfaces 64 and 66 may determine an actuation force of hydraulic actuators 30*a–c*. A sealing member (not shown), such as an o-ring, may be connected to piston 60 to restrict a flow of fluid between an internal wall of tube 52 and an outer cylindrical surface of piston 60.

Head-end supply valve 32 may be disposed between source 28 and first chamber 56 and configured to regulate a flow of pressurized fluid to first chamber 56 in response to a command velocity from controller 48. Specifically, head-end supply valve 32 may include a proportional spring biased valve mechanism that is solenoid actuated and configured to move between a first position at which fluid is allowed to flow into first chamber 56, and a second position at which fluid flow is blocked from first chamber 56. Head-end supply valve 32 may be movable to any position between the first and second positions to vary the rate of flow into first chamber 56, thereby affecting the velocity of hydraulic actuators 30*a–c*. It is contemplated that head-end supply valve 32 may alternatively be hydraulically actuated, mechanically actuated, pneumatically actuated, or actuated in any other suitable manner. It is further contemplated that head-end supply valve 32 may be configured to allow fluid from first chamber 56 to flow through head-end supply valve 32 during a regeneration event when a pressure within first chamber 56 exceeds a pressure directed to head-end supply valve 32 from source 28.

Head-end drain valve 34 may be disposed between first chamber 56 and tank 26, and configured to regulate a flow of fluid from first chamber 56 to tank 26 in response to the command velocity from controller 48. Specifically, head-end drain valve 34 may include a proportional spring biased valve mechanism that is solenoid actuated and configured to move between a first position at which fluid is allowed to flow from first chamber 56 and a second position at which fluid is blocked from flowing from first chamber 56. Head-end drain valve 34 may be movable to any position between the first and second positions to vary the rate of flow from first chamber 56, thereby affecting the velocity of hydraulic actuators 30*a–c*. It is contemplated that head-end drain valve 34 may alternatively be hydraulically actuated, mechanically actuated, pneumatically actuated, or actuated in any other suitable manner.

Rod-end supply valve 36 may be disposed between source 28 and second chamber 58 and configured to regulate a flow of pressurized fluid to second chamber 58 in response to the command velocity from controller 48. Specifically, rod-end supply valve 36 may include a proportional spring biased valve mechanism that is solenoid actuated and configured to move between a first position at which fluid is allowed to flow into second chamber 58 and a second position at which fluid is blocked from second chamber 58. Rod-end supply valve 36 may be movable to any position between the first and second positions to vary the rate of flow into second chamber 58, thereby affecting the velocity of hydraulic actuators 30*a–c*. It is contemplated that rod-end supply valve 36 may alternatively be hydraulically actuated, mechanically actuated, pneumatically actuated, or actuated in any other suitable manner. It is further contemplated that rod-end supply valve 36 may be configured to allow fluid from second chamber 58 to flow through rod-end supply valve 36 during a regeneration event when a pressure within second chamber 58 exceeds a pressure directed to rod-end supply valve 36 from source 28.

Rod-end drain valve 38 may be disposed between second chamber 58 and tank 26 and configured to regulate a flow of fluid from second chamber 58 to tank 26 in response to a command velocity from controller 48. Specifically, rod-end drain valve 38 may include a proportional spring biased valve mechanism that is solenoid actuated and configured to move between a first position at which fluid is allowed to flow from second chamber 58 and a second position at which fluid is blocked from flowing from second chamber 58. Rod-end drain valve 38 may be movable to any position between the first and second positions to vary the rate of flow from second chamber 58, thereby affecting the velocity of hydraulic actuators 30*a–c*. It is contemplated that rod-end drain valve 38 may alternatively be hydraulically actuated, mechanically actuated, pneumatically actuated, or actuated in any other suitable manner.

Head and rod-end supply and drain valves 32–38 may be fluidly interconnected. In particular, head and rod-end supply valves 32, 36 may be connected in parallel to a common supply passageway 68 extending from source 28. Head and rod-end drain valves 34, 38 may be connected in parallel to a common drain passageway 70 leading to tank 26. Head-end supply and drain valves 32, 34 may be connected in parallel to a first chamber passageway 72 for selectively supplying and draining first chamber 56 in response to the command velocity from controller 48. Rod-end supply and drain valves 36, 38 may be connected in parallel to a common second chamber passageway 74 for selectively supplying and draining second chamber 58 in response to the command velocity from controller 48. For the purposes of this disclosure, the pressure of the fluid within first and second chamber passageways 72 and 74 during draining of the associated first or second chamber is defined as back pressure that results from piston 60 pushing fluid through an orifice (not shown) within the associated drain valve. This back pressure may oppose the motion of piston 60.

Head and rod-end pressure sensors 40, 42 may be in fluid communication with first and second chambers 56, 58, respectively and configured to sense the pressure of the fluid within first and second chambers 56, 58. Head and rod-end pressure sensors 40, 42 may be further configured to generate a hydraulic actuator load signal indicative of the pressures within first and second chambers 56, 58.

Linkage sensor 46 may be operably connected to linkage system 12 and configured to monitor an operating parameter of linkage system 12. In one example, linkage sensor 46 may include a gravitational position sensor attached to a side of boom 13 or stick 15. In this example, linkage sensor 46 may be configured to determine a position and/or an orientation of the linkage member to which it is attached. It is also contemplated that linkage sensor 46 may alternatively embody an angle sensor attached to a pivot joint of work machine 10 to determine an orientation of a linkage member of linkage system 12. It is further contemplated that linkage sensor 46 may embody an internal or external position sensor associated with one or more of hydraulic actuators 30*a–c* to determine an extension/retraction position of the respective cylinder. This extension/retraction information may be utilized to calculate the position and/or orientation of the associated linkage members. The position and orientation information monitored and/or determined by linkage sensor 46 may be used to derive additional operating parameters for linkage system 12 such as, for example, velocity, acceleration, jerk, and other parameters known in the art. It is still further contemplated that linkage sensor 46 may embody additional or different types of sensors as are known in the art that can be used to monitor or determine the position, orientation, velocity, and other similar operating parameters of linkage system 12.

Controller 48 may embody a single microprocessor or multiple microprocessors that include a means for controlling an operation of hydraulic system 24. Numerous commercially available microprocessors can be configured to perform the functions of controller 48. It should be appreciated that controller 48 could readily be embodied in a general work machine microprocessor capable of controlling numerous work machine functions. Controller 48 may include a memory, a secondary storage device, a processor, and any other components for running an application. Various other circuits may be associated with controller 48 such as power supply circuitry, signal conditioning circuitry, solenoid driver circuitry, and other types of circuitry.

One or more maps relating operational parameters of linkage system 12 to pressure information for hydraulic actuators 30*a–c* may be stored in the memory of controller 48. Each of these maps may be in the form of a 2-D or 3-D table. Controller 48 may be configured to reference these tables during actuation of head and rod-end supply and drain valves to determine appropriate minimum and/or desired pressure values for the one of the first and second chambers currently being filled with pressurized fluid. It is also contemplated that instead of relating operational parameters of linkage system 12 directly to pressure information for head and rod-end drain valves 34 and 38, the maps may alternatively relate the operational parameters to valve element positions that result in the minimum or desired pressure values. The relationship between valve element position and minimum or desired pressure values may be determined during lab and/or field testing of work machine 10, and may be periodically recalibrated and updated.

Controller 48 may be configured to receive input from operator interface device 22, head and rod-end pressure sensors 40, 42, and linkage sensor 46, and to actuate hydraulic actuators 30*a–c* in response to the input and the relationship map. Specifically, controller 48 may be in communication with head and rod-end supply and drain valves 32–38 of hydraulic actuators 30*a–c* via communication lines 80–86 respectively, with operator interface device 22 via a communication line 88, with head and rod-end pressure sensors 40, 42 via communication lines 90 and 92, and with linkage sensor 46 via a communication line 93, respectively. Controller 48 may receive the interface device position signal from operator interface device 22, the linkage parameter signal from linkage sensor 46, the pressure signals from head and rod-end pressure sensors 40, 42, and reference the relationship map stored in the memory of controller 48 to determine appropriate pressure values or valve element settings for the one of the first and second chambers that controller 48 is currently filling. Controller 48 may then command movement of the valve elements that result in the minimum or desired pressure values.

INDUSTRIAL APPLICABILITY

The disclosed hydraulic system may be applicable to any work machine that includes a hydraulic actuator where it is desirable to minimize voiding within the hydraulic actuator while improving efficiency of the work machine. The disclosed hydraulic system may minimize voiding by providing back pressure within the hydraulic actuator at a level and at times appropriate for the current operating conditions of the work machine. The operation of hydraulic system 24 will now be explained.

As illustrated in FIG. 2, hydraulic cylinders 30*a–c* may be movable by fluid pressure in response to an operator input. Fluid may be pressurized by source 28 and selectively directed to head-end and rod-end supply valves 32 and 36. In response to an operator input to either extend or retract piston assembly 54 relative to tube 52, controller 48 may direct the pressurized fluid to the appropriate one of first and second chambers 56, 58 by causing one of head-end and rod-end supply valves 32 and 36 to move to the flow-passing position. Substantially simultaneously, controller 48 may actuate the appropriate one of head-end and rod-end drain valves 34, 38 to drain fluid from the appropriate one of the first and second chambers 56, 58 to tank 26, thereby creating a force imbalance on piston 60 that causes piston assembly 54 to move. For example, if an extension of hydraulic cylinders 30*a–c* is requested, head-end supply valve 32 may be moved to the open position to direct pressurized fluid from source 28 to first chamber 56. Substantially simultaneous to the directing of pressurized fluid to first chamber 56, rod-end drain valve 38 may be moved to the open position to allow fluid from second chamber 58 to drain to tank 26. If a retraction of hydraulic cylinders 30*a–c* is requested, rod-end supply valve 36 may be moved to the open position to direct pressurized fluid from source 28 to second chamber 58. Substantially simultaneous to the directing of pressurized fluid to second chamber 58, head-end drain valve 34 may be moved to the open position to allow fluid from first chamber 56 to drain to tank 26.

During movement of linkage system 12, it is possible for gravity acting on one or more members of linkage system 12 to move piston 60 in a direction causing expansion in one of first and second chambers 56, 58 faster than pressurized fluid can be introduced into the chamber. For example, during downward and/or inward movement of stick 15, a heavy load within work tool 14 may drive stick 15 in such a way that fluid is forced from second chamber 58 of hydraulic actuator 30*b* faster than fluid can fill first chamber 56. Without intervention, the pressure within first chamber 56 may drop to a point where movement of the linkage system may be unpredictable or undesirable (voiding). In order to prevent this voiding situation, it may be necessary to increase the back pressure in second chamber passageway 74 to opposes motion of piston assembly 54.

Back pressure may be increased by moving the valve element of the draining valve toward the closed direction. In the example described above, back pressure within second chamber passageway 74 may be increased by moving the valve element of rod-end drain valve 38 to increase flow restriction from second chamber 58. The increasing restriction results in increased back pressure.

Controller 48 may be configured to increase the back pressure of the draining valve in response to various inputs. In the example above, controller 48 may receive a signal from head-end pressure sensor 40 indicating a low pressure level within first chamber 56 that is filling, signifying that voiding is already occurring or may be about to occur. Controller 48 may then determine an operating condition (position, orientation, velocity, load, etc.) of linkage system 12 via linkage sensor 46 and determine either a desired pressure value or a minimum pressure value from the relationship map stored in the controller's memory that corresponds to that operating condition. Controller 48 may then compare the pressure signal from head-end pressure sensor 40 with the desired or minimum pressure value and move the valve element of rod-end drain valve 38 to either increase the flow restriction through that valve. Alternatively, controller 48 may reference only the operating condition of linkage system 12 with the map stored in the memory of controller 48 to determine an appropriate position of the valve element of the draining valve that results in the desired or minimum back pressure value.

Although the example described above references a low pressure situation within first chamber 56, controller 48 would respond similarly to a low pressure situation within second chamber 58. Likewise, controller 48 may react to a high pressure situation in either of first or second chambers 56 and 58 by moving the appropriate valve elements to decrease flow restriction, thereby lowering pressure within the associated chamber.

Because controller 48 selectively increases back pressure to oppose piston movement, hydraulic system 24 is efficient. Specifically, because controller 48 only increases flow restriction when a potential for voiding exists, the output of source 28 is only increased during those situations rather than constantly operating at a higher energy consumption rate. Further, because the amount of restriction is proportional to the potential for voiding, source 28 may be operated at a lower average energy consumption rate, as compared to constantly operating at the maximum restriction.

In addition, because controller 48 can control back pressure in response to an operating condition of linkage system 12, velocity control of linkage system 12 may be improved.

Specifically, if the potential for voiding is minimal, flow restriction from either first or second chambers 56, 58 may be reduced to increase velocity of the associated linkage members. In contrast, if more precise control over positioning of the linkage member of linkage system 12 is desired, controller 48 may increase the flow restrictions. These increase or decreased flow restrictions may be related to angular orientations and/or positions of the linkage members of linkage system 12. For example, when work tool 14 is extended to an upper angle or position where sufficient ground clearance is available, increased velocity may be desired to improve cycle time. When work tool 14 is at a lower angle or position for loading or unloading, slower velocities may be desired for improved accuracy in the placement of work tool 14.

It will be apparent to those skilled in the art that various modifications and variations can be made to the disclosed hydraulic system. Other embodiments will be apparent to those skilled in the art from consideration of the specification and practice of the disclosed hydraulic system. It is intended that the specification and examples be considered as exemplary only, with a true scope being indicated by the following claims and their equivalents.

What is claimed is:

1. A hydraulic system for a machine having a linkage system, comprising:

a tank configured to hold a supply of fluid;

at least one hydraulic actuator associated with the linkage system to affect movement of the linkage system, the at least one hydraulic actuator having a first pressure chamber and a second pressure chamber;

four independent metering valves associated with the at least one hydraulic actuator, with one of the independent metering valves associated with the first pressure chamber and having a valve element movable between a first position at which fluid communication between the first pressure chamber and the tank is blocked, and a second position at which fluid is allowed to drain from the first pressure chamber to the tank;

at least one sensor configured to sense a parameter indicative of a pressure in the second pressure chamber; and a controller in communication with the one independent metering valve and the sensor, the controller configured to move the valve element of the one independent metering valve in response to the sensed parameter indicative of a pressure in the second pressure chamber toward a position to minimize voiding in the second pressure chamber.

2. The hydraulic system of claim 1, wherein the controller is configured to move the valve element toward the first position to provide back pressure in the first pressure chamber when the pressure in the second pressure chamber is below a predetermined pressure.

3. The hydraulic system of claim 1, further including a sensor configured to sense at least one operating parameter of the linkage system and to generate a signal indicative of the at least one operating parameter, wherein the controller is in communication with the sensor and configured to move the valve element of the one independent metering valve in further response to the signal.

4. The hydraulic system of claim 3, wherein the controller includes a memory having at least one map stored therein that relates the at least one operating parameter to a pressure in the second pressure chamber, the controller further configured to reference the at least one map and determine a desired pressure for the second pressure chamber in response to the signal.

5. The hydraulic system of claim 3, wherein the at least one operating parameter is a position of the linkage system.

6. The hydraulic system of claim 3, wherein the at least one operating parameter is an orientation of the linkage system.

7. The hydraulic system of claim 3, wherein the at least one operating parameter is a velocity of the linkage system.

8. The hydraulic system of claim 3, wherein the at least one operating parameter is a load on the linkage system.

9. A hydraulic system for a machine having a linkage system, comprising:

a tank configured to hold a supply of fluid;

at least one hydraulic actuator associated with the linkage system to affect movement of the linkage system, the at least one hydraulic actuator having at least one pressure chamber;

two independent metering valves associated with the at least one pressure chamber with one of the independent metering valves having a valve element movable between a first position at which fluid communication between the at least one pressure chamber and the tank is blocked, and a second position at which fluid is allowed to drain from the at least one pressure chamber to the tank;

a sensor configured to sense at least one operating parameter of the linkage system and to generate a signal indicative of the at least one operating parameter; and a controller in communication with the one independent metering valve and the sensor, the controller configured to move the valve element of the one independent metering valve in response to the signal toward a position to minimize voiding in the at least one hydraulic actuator.

10. The hydraulic system of claim 9, wherein the controller includes a memory having at least one map stored therein that relates the at least one operating parameter to a position of the valve element of the one independent metering valve, the controller further configured to reference the at least one map and determine a desired position for the valve element in response to the signal.

11. The hydraulic system of claim 9, wherein the at least one operating parameter is a position of the linkage system.

12. The hydraulic system of claim 9, wherein the at least one operating parameter is an orientation of the linkage system.

13. The hydraulic system of claim 9, wherein the at least one operating parameter is a velocity of the linkage system.

14. The hydraulic system of claim 9, wherein the at least one operating parameter is a load on the linkage system.

15. A method of operating a hydraulic system associated with a linkage system, the hydraulic system including at least one hydraulic actuator having first and second pressure chambers and associated with the linkage system to affect movement of the linkage system, and four independent metering valves associated with the at least one hydraulic actuator, with one of the independent metering valves associated with the first pressure chamber and having a valve element movable between a first position at which fluid communication between the first pressure chamber and the tank is blocked, and a second position at which fluid is allowed to drain from the first pressure chamber to the tank, the method comprising:

moving a valve element of the one independent metering valve between a first position and a second position to selectively block fluid from or drain fluid from the first pressure chamber of the at least one hydraulic actuator to the tank;

sensing a parameter indicative of a pressure within the second pressure chamber of the at least one hydraulic actuator; and controlling movement of the valve element of the one independent metering valve between the first and second positions in response to the sensed parameter indicative of a pressure within the second pressure chamber toward a position to minimize voiding in the second pressure chamber.

16. The method of claim 15, wherein controlling movement includes moving the valve element of the one independent metering valve toward the first position to provide back pressure in the first pressure chamber when a pressure in the second pressure chamber drops below a predetermined pressure.

17. The method of claim 15, further including:

sensing an operating parameter of the linkage system;

generating a signal indicative of the operating parameter; and controlling movement of the valve element of the one independent metering valve between the first and second positions in further response to the signal.

18. The method of claim 17, wherein the hydraulic system includes a controller having a memory with at least one map stored therein that relates the at least one operating parameter to a pressure in the second pressure chamber and the method further includes referencing the at least one map to determine a desired pressure for the second pressure chamber in response to the signal.

19. The method of claim 17, wherein the at least one operating parameter is a position of the linkage system.

20. The method of claim 17, wherein the at least one operating parameter is an orientation of the linkage system.

21. The method of claim 17, wherein the at least one operating parameter is a velocity of the linkage system.

22. The method of claim 17, wherein the at least one operating parameter is a load on the linkage system.

23. A method of operating a hydraulic system associated with a linkage system, the hydraulic system including at least one hydraulic actuator having at least one chamber and associated with the linkage system to affect movement of the linkage system, and two independent metering valves associated with the at least one chamber, with one of the independent metering valves having a valve element movable between a first position at which fluid communication between the at least one chamber and a tank is blocked, and a second position at which fluid is allowed to drain from the at least one chamber to the tank, the method comprising:

moving the valve element of the one independent metering valve between a first position and a second position to selectively block fluid from or drain fluid from the at least one chamber of the at least one hydraulic actuator to the tank;

sensing at least one operating parameter of the linkage system;

generating a signal indicative of the at least one operating parameter; and controlling movement of the valve element of the one independent metering valve between the first and second positions in response to the signal to minimize voiding in the at least one hydraulic actuator.

24. The method of claim 23, wherein the hydraulic system includes a controller having a memory with at least one map stored therein that relates the at least one operating parameter to a position of the valve element of the one independent metering valve and the method further includes referencing the at least one map to determine a desired position for the valve element of the one independent metering valve in response to the signal.

25. The method of claim 23, wherein the at least one operating parameter is a position of the linkage system.

26. The method of claim 23, wherein the at least one operating parameter is an orientation of the linkage system.

27. The method of claim 23, wherein the at least one operating parameter is a velocity of the linkage system.

28. The method of claim 23, wherein the at least one operating parameter is a load on the linkage system.

29. A machine comprising:

a work tool;

a linkage system operably connected to the work tool; and a hydraulic system configured to affect movement of the linkage system, the hydraulic system including:

a tank configured to hold a supply of fluid;

at least one hydraulic actuator associated with the linkage system to affect movement of the linkage system, the at least one hydraulic actuator having a first pressure chamber and a second pressure chamber;

four independent metering valves associated with the at least one hydraulic actuator, with one of the independent metering valves associated with the first pressure chamber and having a valve element movable between a first position at which fluid communication between the first pressure chamber and the tank is blocked, and a second position at which fluid is allowed to drain from the first pressure chamber to the tank;

at least one sensor configured to sense a parameter indicative of a pressure in the second pressure chamber; and a controller in communication with the one independent metering valve and the sensor, the controller configured to move the valve element of the one independent metering valve in response to the sensed parameter indicative of a pressure in the second pressure chamber toward a position to minimize voiding in the second pressure chamber.

30. The machine of claim 29, wherein the controller is configured to move the valve element toward the first position to provide back pressure in the first pressure chamber when the pressure in the second pressure chamber is below a predetermined pressure.

31. The machine of claim 29, further including a sensor configured to sense at least one operating parameter of the linkage system and to generate a signal indicative of the at least one operating parameter, wherein the controller is in communication with the sensor and configured to move the valve element of the one independent metering valve in further response to the signal.

32. The machine of claim 31, wherein the controller includes a memory having at least one map stored therein that relates the at least one operating parameter to a pressure in the second pressure chamber, the controller further configured to reference the at least one map and determine a desired pressure for the second pressure chamber in response to the signal.

33. The machine of claim 29, wherein the at least one operating parameter includes at least one of a position of the linkage system, an orientation of the linkage system, a velocity of the linkage system; and a load on the linkage system.

34. A machine comprising:

a work tool;

a linkage system operably connected to the work tool; and a hydraulic system configured to affect movement of the linkage system, the hydraulic system including:

a tank configured to hold a supply of fluid;

at least one hydraulic actuator associated with the linkage system to affect movement of the linkage system, the at least one hydraulic actuator having at least one pressure chamber;

two independent metering valves associated with the at least one pressure chamber with one of the independent metering valves having a valve element movable between a first position at which fluid communication between the at least one pressure chamber and the tank is blocked, and a second position at which fluid is allowed to drain from the at least one pressure chamber to the tank;

a sensor configured to sense at least one operating parameter of the linkage system and to generate a signal indicative of the at least one operating parameter; and a controller in communication with the one independent metering valve and the sensor, the controller configured to move the valve element of the one independent metering valve in response to the signal toward a position to minimize voiding in the at least one hydraulic actuator.

35. The machine of claim 34, wherein the controller includes a memory having at least one map stored therein that relates the at least one operating parameter to a position of the valve element of the one independent metering valve, the controller further configured to reference the at least one map and determine a desired position for the valve element in response to the signal.

36. The machine of claim 34, wherein the at least one operating parameter includes at least one of a position of the linkage system; an orientation of the linkage system; a velocity of the linkage system; and a load on the linkage system.

* * * * *